US007055251B1

(12) United States Patent
Smith et al.

(10) Patent No.: US 7,055,251 B1
(45) Date of Patent: Jun. 6, 2006

(54) COLUMN PLACEMENT TEMPLATE

(76) Inventors: Timothy M. Smith, 4300 N. Ocean Blvd., H-10, Fort Lauderdale, FL (US) 33308; George L. Southworth, 3391 Eagle Nest Dr., Hernando Beach, FL (US) 34607

( * ) Notice: Subject to any disclaimer, the term of this patent is extended or adjusted under 35 U.S.C. 154(b) by 0 days.

(21) Appl. No.: 10/992,978

(22) Filed: Nov. 19, 2004

(51) Int. Cl.
*E02D 27/42* (2006.01)

(52) U.S. Cl. ..... 33/1 H; 14/77.3; 52/745.17

(58) Field of Classification Search ..... 33/562, 33/1 H; 14/77.1, 77.3; 52/294–299, 745.14, 52/745.17, 745.18; 248/228.1, 228.5; 249/48, 249/51

See application file for complete search history.

(56) References Cited

U.S. PATENT DOCUMENTS 1,707,894 A * 4/1929 Bergesen, Sr. ..... 248/235
3,299,191 A * 1/1967 Alexaner et al. ..... 264/34
3,367,119 A * 2/1968 Rybicki ..... 405/196
3,392,534 A * 7/1968 Blenkarn ..... 405/203
3,750,210 A * 8/1973 Barnard et al. ..... 14/77.1
4,492,496 A * 1/1985 Arnold ..... 405/303
4,657,437 A * 4/1987 Breeden ..... 405/198
5,060,435 A * 10/1991 Bogdanow ..... 52/292
5,234,288 A * 8/1993 Bone ..... 405/239
5,429,455 A * 7/1995 Bone ..... 405/239
5,771,518 A * 6/1998 Roberts ..... 14/73.1
5,794,387 A * 8/1998 Crookham ..... 52/122.1
6,085,432 A * 7/2000 Van der Sluis et al. ..... 33/613
6,955,025 B1 * 10/2005 Dehlsen et al. ..... 52/745.17
2004/0093817 A1 * 5/2004 Pujol Barcons ..... 52/294

FOREIGN PATENT DOCUMENTS

JP 6115520 A * 7/1986

* cited by examiner

*Primary Examiner*—R. Alexander Smith
(74) *Attorney, Agent, or Firm*—Steven M. Greenberg, Esq.; Christopher & Weisberg, P.A.

(57) ABSTRACT

A template system and column placement method which facilitates the placement of a column resulting in enhanced placement efficiencies for large scale column construction projects. In a preferred aspect of the present invention, a template for column placement can include a frame, at least one pivotal column engagement scaffold coupled to the frame and at least one docking collar extending from the pivotal column engagement scaffold and configured to secure a column to the pivotal column engagement scaffold. Additionally, a base can be provided in order to support the frame.

3 Claims, 4 Drawing Sheets

COLUMN PLACEMENT TEMPLATE

FIELD OF THE INVENTION

The present invention relates to column placement and more particularly to a template for fixing the placement of a column.

BACKGROUND OF THE INVENTION

Column placement involves the physical disposition of a column—typically concrete—in or proximate to the ground for supporting associated structure. Columns often support bridges, roadways, platforms and walls, to name but a few associated structures. Given the massive weight of many associated structures supported by columns, precision in the placement of the columns can be critical to ensure the integrity of the associated structures. Moreover, given the sheer manpower required to place columns and associated structure, misplacement of a column can result in substantial cost overruns. In the modern world of razor-slim margins in civil works project management, cost overruns can be intolerable and can form the difference between a loss on a project and profitability.

Conventional column placement generally involves the lifting of a pre-cast column by a crane to a position above a drill hole. Several workers can subsequently guide the hovering column down and into the hole where the column can be secured by temporary scaffolding. Recognizing the imprecise nature of this exercise, many skilled artisans prefer the use of a template in placing the column. A template generally includes a scaffold-like arrangement of wooden or metal bars configured to support the placement of a column in or above a hole. Ordinarily, the template can be placed such that an opening in the template can align with a hole in the ground, A column can be lowered by crane and guided through the hole into the ground. Still, given the mass of a typical column, many works are required to position and support the column in the hole.

FIG. 1 illustrates a typical template arrangement, such as a "Hubbard" arrangement. A typical template arrangement includes a template body 120 supported over a hole 130 in the ground 140 by one or more template feet 160. A column 110 can be lowered through the template body 120 into the hole 130 and secured in place by one or more adjustable straps 150 such as "come-alongs" as is known in the art. Notably, the adjustable straps 150 can be coupled to the template body 120 and tightened individually so as to cause the column 110 to stand as close to vertical as possible without unduly leaning to any one side.

It will be apparent to the skilled artisan, however, that controlling the vertical placement of the column 110 through the use of multiple individually adjustable straps 150 can be resource intensive and quite difficult given the number of control points dictating the vertical placement of the column and the distance between each control point. Moreover, the mass of the column 110 often can cause shifting in the placement of the template body 120 in respect to the hole given the free-floating nature of the template feet 160. Accordingly, substantial imprecision can result.

The skilled artisan further will recognize several other deficiencies associated with the conventional column placement template. Most notably, only a single column can be placed at any one time. Also, once a column has been placed and has been secured in the hole in the ground, placing the next column may require alignment with the previously set column. Preserving the accuracy of placement of a new column relative to an existing column can introduce an entirely new set of difficulties. Additionally, the process of auger-cast drilling a hole prior to the placement of a column through the template, and the subsequent dismantling of the template once the column has set in order to remove the template can result in substantial time and manpower consumption. Thus, a more efficient template for placing columns would be desirable.

SUMMARY OF THE INVENTION

The present invention advantageously provides a column placement template which overcomes the limitations of the prior art and provides a novel and non-obvious template system and column placement method which facilitates the placement of a column resulting in enhanced placement efficiencies for large scale column construction projects. In a preferred aspect of the present invention, a template for column placement can include a frame, at least one pivotal column engagement scaffold coupled to the frame and at least one docking collar extending from the pivotal column engagement scaffold and configured to secure a column to the pivotal column engagement scaffold. A base further can be provided for supporting the frame, and optionally, the frame can be adjustably mounted to the base.

Notably, the base can include at least one engageable stabilizing pin. Moreover, either or both of the base and the frame can include leveling feet. In this regard, a hand crank further can be provided for operating the leveling feet. Also, the pivotal column engagement scaffold preferably can include a counterweight disposed at a bottom portion of the scaffold opposite an axis of rotation of the scaffold. Also, the docking collar can include a removable face plate. The template yet further can include a multiplicity of shims configured for insertion between a column secured by the docking collar and an interior portion of the docking collar.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

The present invention is a column placement template configured for the efficient installation of one or more columns in one or more corresponding holes. In accordance with the present invention, the column placement template can include pivotal column engagement scaffolding coupled to a template frame. The template frame can be supported by a template base which can include leveling feet such that the template base can be adjusted vertically to achieve a level foundation for the template. The template base further can include engageable stabilizing pins which when activated can engage the ground so as to prevent the lateral and rotational movement of the template base. Preferably, at least two pivotal column engagement scaffolds can be disposed at opposite ends of the template base. Additionally, the pivotal column engagement scaffolds can include counterweights opposite an access of rotation for the pivotal column scaffolding to facilitate the manual rotation of the scaffolds.

In a preferred aspect of the invention, at least one docking collar and preferably at least two docking collars can be incorporated in each pivotal column engagement scaffold. Each docking collar can be configured with a removable face plate so as to permit the engagement of column in the docking collar. In this regard, when secured to the docking collar, the removable face can enclose and secure a column inside the docking collar. To provide for a snug fit, one or more shims can be disposed between the docking collar and an enclosed portion of a column. Optionally, the function of the shims can be performed by mechanically engageable clamps which can be activated to engage the column on different sides of the column.

Figure 1:
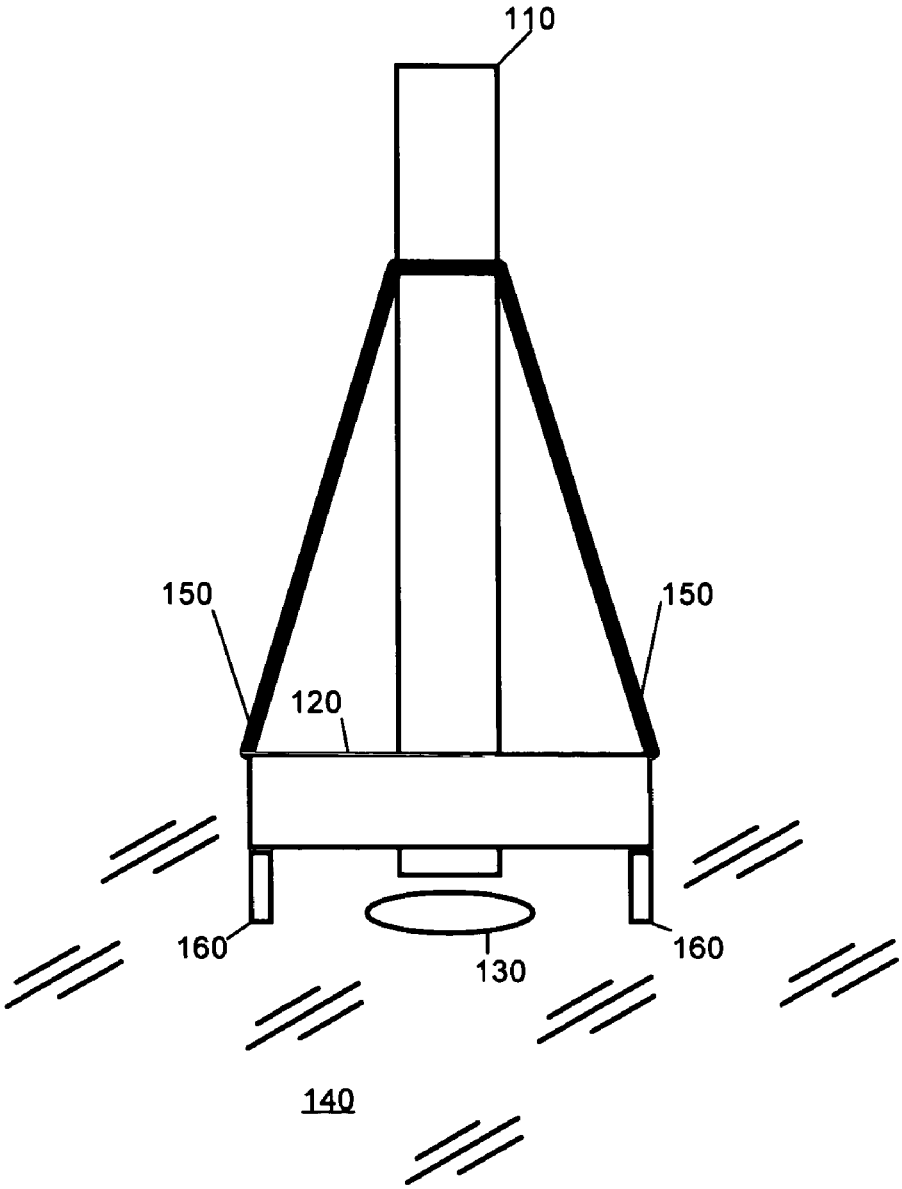
FIG. 1 (Prior Art)
FIG. 1 is a side elevation illustrating a template arranged for the placement of a column in a hole as is known in the art.
Figure 2:
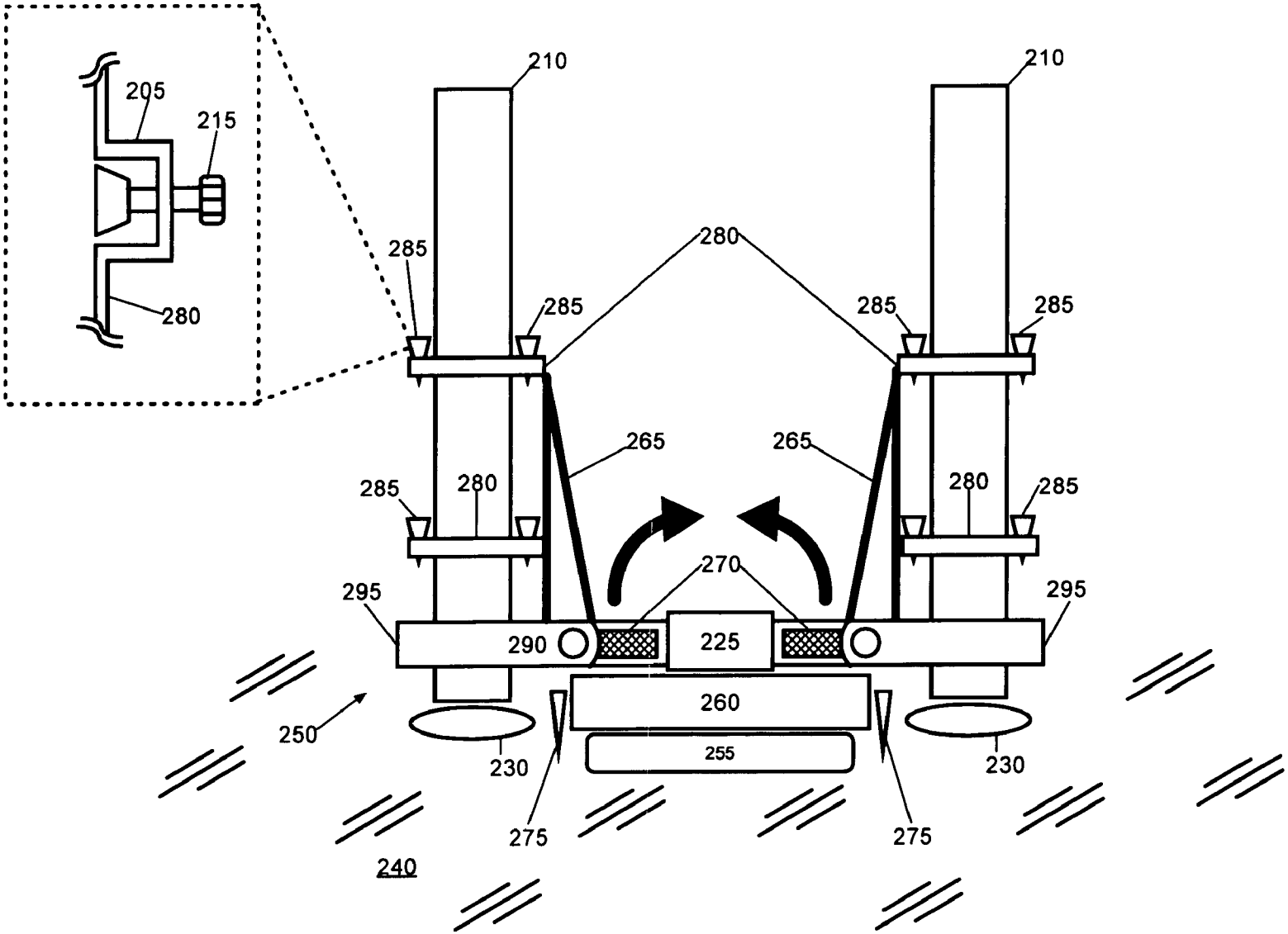
FIG. 2 is a side elevation illustrating a template arranged for the placement of columns in holes in accordance with the present invention.

In more particular illustration of a preferred arrangement, FIG. 2 is a side elevation illustrating a template configured for the placement of columns in holes in the ground in accordance with the present invention. The template 250 can include frame 290 and one or more pivotal column engagement scaffolds 295. The frame 290 can be unitary in design, or the frame 290 can be telescopically adjustable by securing separate ends of the base 290 into a sleeve 225. The frame 290 can be mounted to a base 260. In particular, the bottom portion of the frame 290 can be secured to the top portion of the base 260 using bolts which can extend from the frame 290 to the base 260 through a hole or channel formed in the base 260. In this way, the frame 290 can be adjustably mounted to the base 260 by sliding the frame 290 along the channel of the base 260 until a desired position is reached. Subsequently, the frame 290 can be "tightened down" to the base 260.

Importantly, the base 260 can be of substantial mass to support the operation of the pivotal column engagement scaffolds 295 when the pivotal column engagement scaffolds 295 secure one or more columns 210 in one or more corresponding holes 230 in the ground 240. Moreover, an adjustable ballast 255 can be affixed to the base 260, for instance by bolting the ballast 255 to the bottom surface of the base 260. Consequently, the ballast 255 can be used to shift the center of gravity of the base 260 to accommodate non-level sites such as canal embankments in the like.

Figure 4:
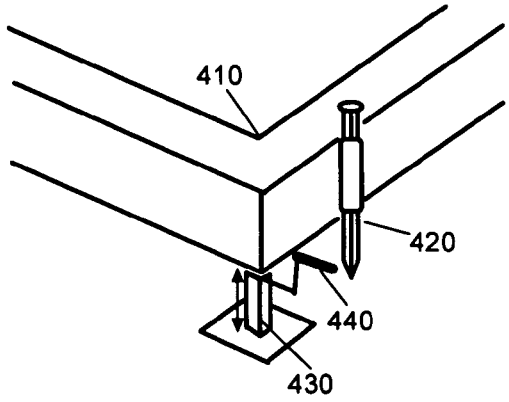
FIG. 4 is a perspective view of an base corner of the adjustable base of the template of FIG. 2; and, FIG. 5 is a template side view illustrating the operation of the template of FIG. 1.

In a preferred aspect of the invention, one or more engageable stabilizing pins 275 can be affixed to the base 260 so that when activated, the engageable stabilizing pins 275 can inhibit the lateral or translational movement of the base 260 relative to the ground 240 and the columns 210. For instance, referring to FIG. 4, each engageable stabilizing pin 420 can be coupled to the frame 410 of the base of the template. Moreover, leveling feet 430 can be coupled to the frame 410 so as to provide for vertical leveling of the base of the template. In this regard, an adjustable crank and shaft 440 can be configured to vertically adjust the leveling feet 430 so as to provide a control point for leveling the frame 410.

Figure 3:
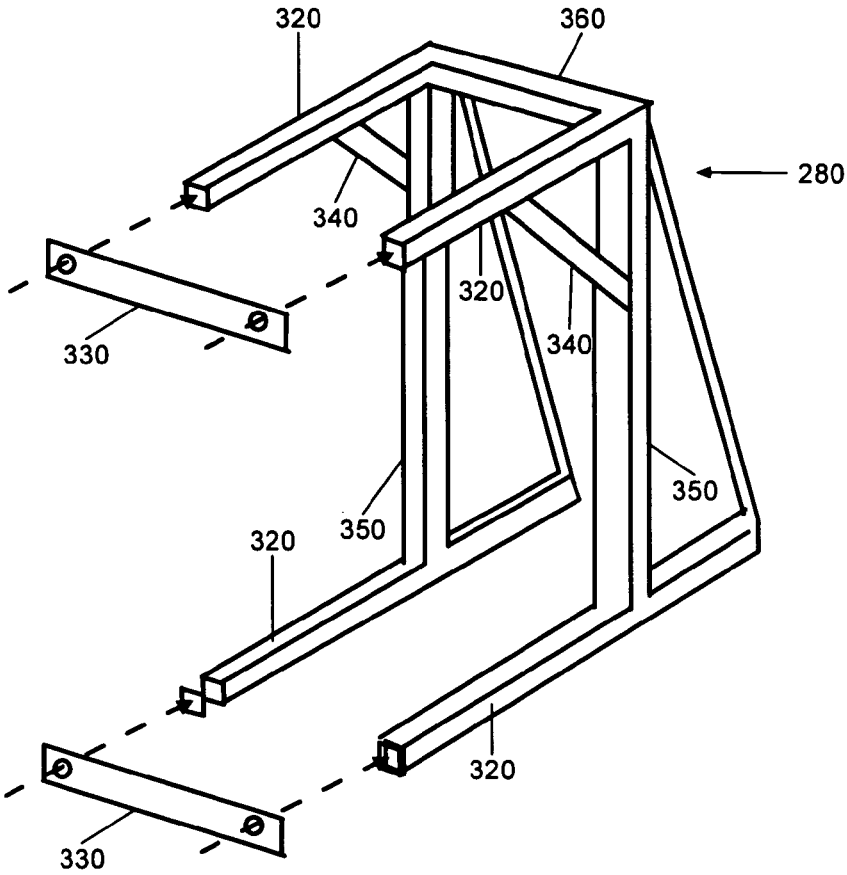
FIG. 3 is a perspective view of the docking collar of a pivotal column engagement scaffold of the template of FIG. 2.

Referring again to FIG. 2, to support the engagement of the columns 210, each of the pivotal column engagement scaffolds 295 include scaffolding supports 265 and a docking collar 280. The docking collar 280 can be configured to engage and enclose a column 210 when the column is placed over a hole, spread footing, or other such target 230 in the ground 240. In this regard, referring to FIG. 3, the docking collar 280 can include vertical supports 350, and fixed arms 320 protruding from a fixed backing 360 (which can be substituted for a specifically configured backing plate). The fixed arms 320 further can be structurally reinforced through the coupling of the inclined struts 340 to the vertical supports 350. As it will be apparent from the illustration, multiple sets of fixed arms 320 can protrude from the frame of the docking collar to provide additional support. In the exemplary embodiment, two sets of fixed arms 320 are utilized in each docking collar 280 although a single set can suffice as can several.

Notably, to permit the docking of a column in the arms 320 of the docking collar 280, a confinement element 330 further can be included so that when secured to the arms 320 of the docking collar 280 (or to the fixed backing 360) utilizing a bolt, an enclosed column can be limited in its lateral and translational movement. Notwithstanding the foregoing, the structural configuration of the docking collar 280 is not limited to the embodiment shown in FIG. 3 and other configurations are contemplated to fall within the scope of the invention including any configuration in which a column can be engaged within the docking collar 280 and secured through the operation of a sealing mechanism which can be adjusted to permit the entry of a column into the interior portion of the docking collar 280, for example where the docking collar 280 is a friction collar. To that end, a cylindrical docking collar or a docking collar 280 having an elliptical cross-section also can suffice for the intended purpose of the docking collar 280.

Referring once again to FIG. 2, a counter weight 270 can be coupled to or incorporated with each the pivotal column engagement scaffold 295 opposite an axis of rotation of the pivotal column engagement scaffold 295 so as to facilitate the inward and outward rotation of the pivotal column engagement scaffold 295. In this way, the pivotal column engagement scaffold 295 can be removed from the immediate vicinity of the hole 230 as the hole is drilled or otherwise formed (presumably through the operation of a drill), and also from the immediate vicinity of a column 210 as the column 210 is lowered into place (presumably through the operation of a lifting device such as a crane) over the hole 230. Once the column 210 has been lowered into the hole 230, the pivotal column engagement scaffold 295 can be rotated outward towards the column 210 and secured to the column.

To provide a snug fit and to inhibit the movement of the column 210 from its true vertical position, one or more shims 285 can be applied to the space between the docking collar 280 and the column 210. The shims 285 can include wedge type structures which when set between the column 210 and the collar 280, force a snug fit. In an alternative embodiment, however, in substitute for wedges, the shims can include mechanically activated screw clamps 215 as shown in FIG. 2. Specifically, in the alternative embodiment, the docking collar interior service can include indentation 205 at select locations in which a clamp 215 can retract when activated by a wrench or other activating tool. In this way, the process of securing a column 210 to the collar 280 can include the mere activation of each clamp 215 by mechanical or manual means.

Figure 5:
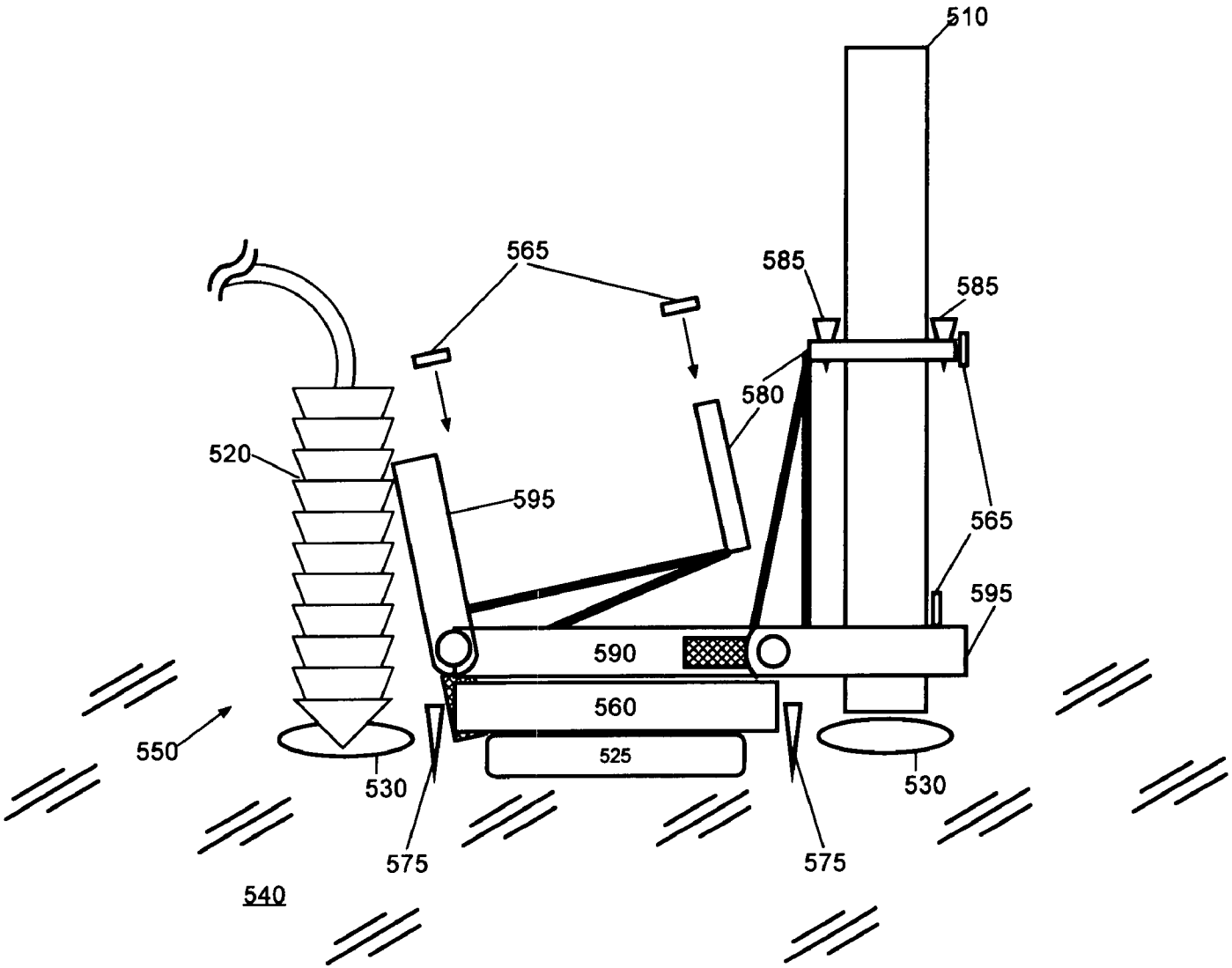

In more particular illustration, FIG. 5 is a template side view illustrating the operation of the template 250 of FIG. 2 when drilling holes 230 and placing columns 210 therein in a process of placing columns (for instance, in the construction of sound barrier walls in highway construction). As in the case of the template 250 of FIG. 2, in the template 550 of FIG. 5, the template 550 can include a template base 560 coupled to a ballast 525, the base 560 supporting a template frame 590 and one or more pivotal column engagement scaffolds 595 disposed at opposite ends of the template frame 590. The template 550 can be positioned over the target site of one or more holes 530 to be formed to support the placement of corresponding columns 510, albeit the invention is not limited to the placement of columns over holes and spread footings and other such column supporting structure can suffice. Once positioned over the target site, the base 560 can be secured from movement through the operation of the engageable stabilizing pins 575. Optionally, the base 560 further can be leveled through the operation of leveling feet (not shown for the simplicity of illustration).

To form the hole 530, a proximate pivotal column engagement scaffold 595 positioned over the hole 530 can be rotated inwardly as shown in FIG. 5. In this way, a drill 520 can be positioned over the target area and the hole 530 can be formed. Notably, the skilled artisan will recognize many techniques for drilling holes including that which is disclosed in U.S. Pat. Nos. 5,429,455 and 5,234,288 to Bone entitled INTEGRATED COLUMN AND PILE issued on Jul. 4, 1995. Once the hole 530 has been formed, the column 510 can be secured to the hole 530 either by direct placement in the hole 530 or by attaching the column 510 to a foundational structure established within the hole 530.

Once the column 510 can been secured to the hole 530, the pivotal column engagement scaffold 595 can be rotated outwardly towards the column 510 so that the arms of the docking collar 580 engages the column 510 as shown in FIG. 5. Optionally, additional docking collars (not shown) can engage the column 510 so as to further secure the column in place. In this regard, the use of the docking collar 580 can also secure the column 510 at a desired vertical position as well as a desired horizontal position. In any case, preferably, a docking collar can be placed at or near the bottom portion of the pivotal column engagement scaffold 595. In any case, once the docking collar 580 has engaged the column 510, the column 510 can be secured within the docking collar 580 by attaching the confinement element 565 to the docking collar 580. Furthermore, additional confinement elements 565 can be attached to other docking collars included as part of the pivotal column engagement scaffolds 595 (or optionally as part of the template frame 590. When the column 510 has been secured within the docking collar 580, the column 580 can be leveled vertically and stabilized through the insertion of shims 585. The insertion of the shims 585 can provide for a snug fit for the column 510 in the docking collar 580. As an alternatively, mechanically engageable clamps can be applied to the column 510 so as to provide a snug fit for the column 510 in the docking collar 580.

Several advantages of the template of the present invention will be apparent to the skilled artisan. First and foremost, by including two pivotal column engagement scaffolds in a single template, two columns can be placed at once resulting in a half-time reduction in the placement of a series of columns. Second, by utilizing the pivotal column engagement scaffolds, the template placement can be coordinated with the drilling of the hole and once the column has been fixed in the hole, the template need not be completely dismantled to remove the template. Rather, the pivotal column engagement scaffolds can be rotated away from the columns and the template simply can be removed from the vicinity of the columns.

The rigid nature of the docking collars obviate the use of straps or come-alongs in positing the column vertically over the hole. Moreover, the shims provide a snug fit of the column in the docking collar. Importantly, all control points for adjusting the lateral and translational position of the columns in the hole are located within arms reach about the docking collar. Finally, the base can be secured firmly to the ground through the operation of the engageable stabilizing pins so as to prevent the movement of the base, and the base can be precisely leveled through the operation of the leveling feet. As a result, inaccuracies associated with conventional templates can be eliminated and columns can be most efficiently placed in holes at a minimum of cost.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A template for column placement, the template comprising:

a frame;

at least one pivotal column engagement scaffold coupled to said frame; and, at least one docking collar extending from said at least one pivotal column engagement scaffold and configured to secure a column to said at least one pivotal column engagement scaffold, wherein said at least one pivotal column engagement scaffold comprises a counterweight disposed at a bottom portion of said scaffold opposite an axis of rotation of said scaffold.

2. A pivotal column engagement scaffold configured for use with a template for column placement, said scaffold comprising:

at least one vertical support configured for rotatable mounting to a template;

at least one docking collar coupled to said at least one vertical support; and, a counterbalance coupled to a bottom portion of said vertical support opposite said at least one docking collar about an axis of rotation of the scaffold.

3. A method for placing columns in holes in sound wall construction, the method comprising the steps of:

positioning a template between two separate target areas for drilling holes in which columns are to be placed, said positioning comprising aligning individual pivotal column engagement scaffolds over corresponding ones of said two separate target areas;

inwardly rotating said scaffolds;

subsequent to said positioning, drilling holes in said two separate target areas;

placing two columns, each in a separate one of said holes;

outwardly rotating said scaffolds to engage said placed two columns;

securing said columns to said template, each with a docking collar affixed to a corresponding one of said scaffolds;

allowing said columns to set;

inwardly rotating said scaffolds subsequent to said columns having set; and, removing said template from said two separate target areas.

* * * * *